United States Patent [19]

Rosenkranz

[11] 4,362,279

[45] Dec. 7, 1982

[54] WIRE BRAKE FOR A WINDING MACHINE

[75] Inventor: Wolfgang Rosenkranz, Traunreut, Fed. Rep. of Germany

[73] Assignee: Siemens Aktiengesellschaft, Munich, Fed. Rep. of Germany

[21] Appl. No.: 230,949

[22] PCT Filed: May 8, 1980

[86] PCT No.: PCT/DE80/00059

§ 371 Date: Jan. 9, 1981

§ 102(e) Date: Jan. 9, 1981

[87] PCT Pub. No.: WO80/02548

PCT Pub. Date: Nov. 27, 1980

[30] Foreign Application Priority Data

May 11, 1979 [DE] Fed. Rep. of Germany ..... 2919145

[51] Int. Cl.[3] ..... B65H 59/10

[52] U.S. Cl. ..... 242/147 R

[58] Field of Search ..... 242/147 R, 149, 7.13, 242/129.8; 226/195

[56] References Cited

U.S. PATENT DOCUMENTS

| | | | |
|---|---|---|---|
| 2,426,631 | 9/1947 | Mapes | 242/147 R |
| 3,099,419 | 7/1963 | Kerch et al. | 242/147 R |
| 3,164,335 | 1/1965 | Dammar | 242/147 R |

*Primary Examiner*—Stanley N. Gilreath

*Attorney, Agent, or Firm*—Scully, Scott, Murphy & Presser

[57] ABSTRACT

During the winding of coils with a non-circular shape the wire length necessary varies periodically for a trouble-free winding per unit of time. At a high winding rotational speed and unsatisfactory side ratios relative to the coil being wound, the periodic change in the required wire length is so large that with known wire brakes there is no adequate winding quality with a concurrent protective handling of the wire. These opposite goals are reached through the invention with the aid of a controllable wire brake which essentially consists of a plurality of brake strands wound about the wire in a single layer.

5 Claims, 3 Drawing Figures

Figures 1, 2:
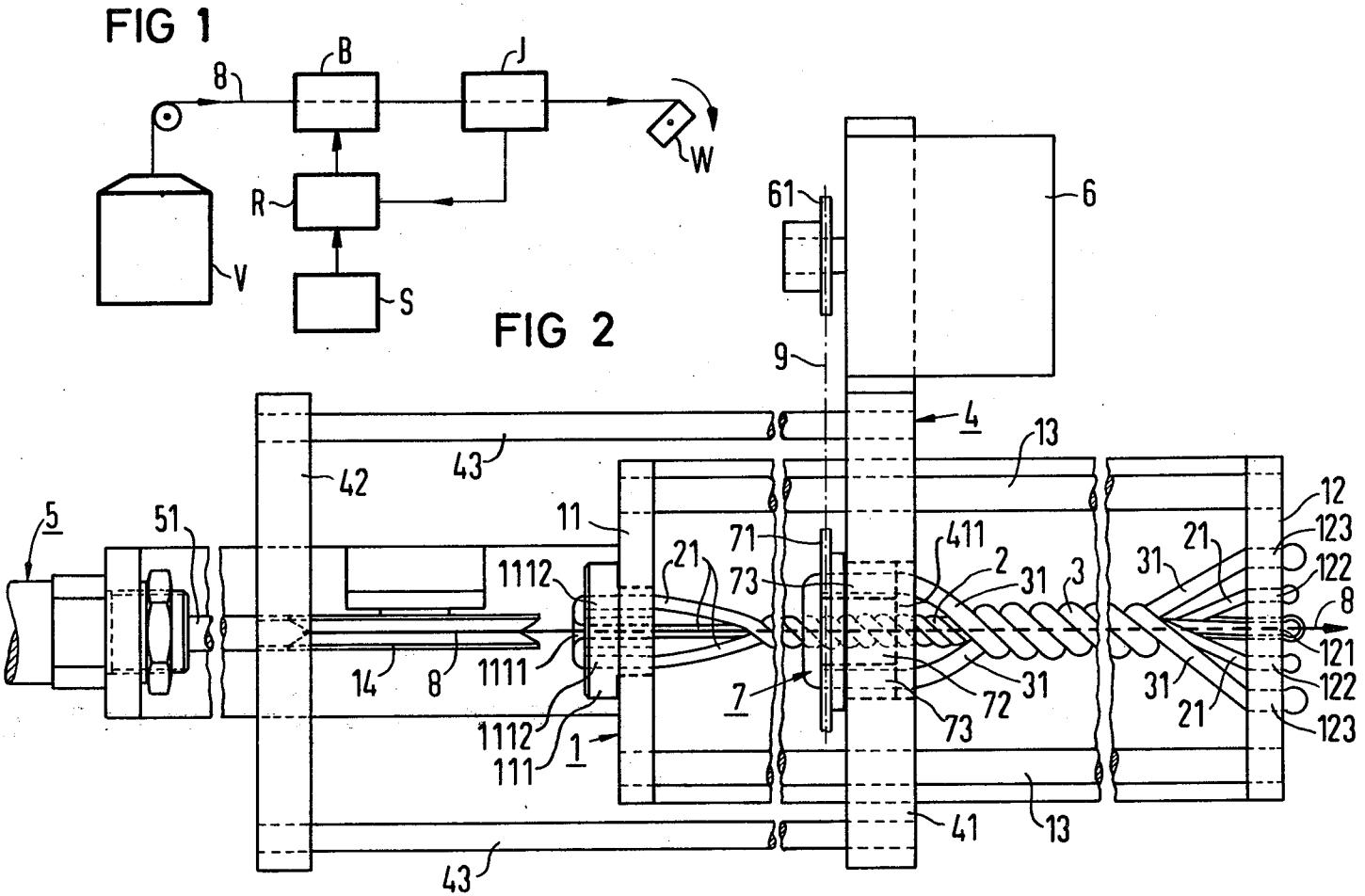

W
J
B
R
S
V
8
6
61
9
4
13
12
123
122
121
21
31
3
2
411
72
73
41
71
7
11
1112
1111
111
1
43
42
14
51
5

WIRE BRAKE FOR A WINDING MACHINE

In the winding of a coil it is necessary, in the interest of a good coiling factor and for a low use of wire, that the wire at the winding station always remains under a predetermined minimum tension; the wire is, accordingly, conducted through a wire brake ahead of the winding station. This wire brake should be so constructed that it will not adversly affect the wire and especially its insulation.

The fulfillment of the previously mentioned requirements on a wire brake presents considerable difficulties when the wire length which is necessary for the production of a winding per unit of time will vary periodically, which is the case during the winding of coils whose configuration deviates from a circular form. Particularly large are these variations in coils with rectangular configurations and unfavorably large ratios of the coil length relative to the coil width, for example, such as are required for lighting fixtures.

Especially critical is the described problem at extremely rapidly running winding machines since here the required wire speed varies between extremely low and extremely high values. Known wire brakes must hereby be set to such high braking values so as to frequently cause tearing of the wire.

The invention solves the addressed problem with a wire brake which is characterized in that the wire which is to be braked is wound in a single layer by a plurality of pressure strands of a pressure cable, which is tensioned between a support frame and a carriage displaceably supported therein by means of a tensioning device and that the pressure strands at one end of the pressure cable are fastened to a correcting element which is rotatably supported in the carriage or within the support frame.

Such a wire brake does not require any additional guide rolls for the wire, whose mass would accelerate the wire during the braking phase.

The braking power is determined by the length of the pressure cable and the extent of motion of the braking strands which is manually or in a motorized mode are adjustable by means of the correcting element, wherein this extent of motion is a measure for the compressive force and the braking surface depends upon the length of the braking cable. A high braking power can thus be distributed over a large surface of the wire so that also hereby there will not occur any adversly affect over the wire or its insulation.

Pursuant to a modification of the invention, the braking effect can be improved even with a more protective handling of the wire in that a specialized braking cable is arranged between the wire which is to be braked and the pressure strands which also consists of a plurality of braking strands wound in a single layer about the wire, which at one end thereof are clamped into the support frame through the intermediary of a twisting device. Hereby, the properties of the braking cable can be optimized exclusively towards its braking function since it itself is practically not subjected to any tensile stress. Accordingly, for the braking strand there can thus be selected such a material which is so soft whereby the surface of the wire which is located within the braking cable stands for at least up to 50% in contact with the braking strands; with the utilization of soft leather strips, even with an almost 100% encompassing can be combined with an extremely protective handling of the insulation. The concept of winding of the strands of the braking and pressure cable can be either in the same direction or in an opposite sense.

The functional division between a braking cable and a pressure cable further renders it possible that also for the pressure cable there can be utilized a material which is optimal for this function; coming into consideration hereby are perlon strands, as well as those formed of steel fibers.

The invention also facilitates the simple holding constant of a predetermined wire tension with the aid of controller, in particular a three-point controller, so that it is no longer necessary to set an excessively high brake power for reasons of safety.

Figure 3:
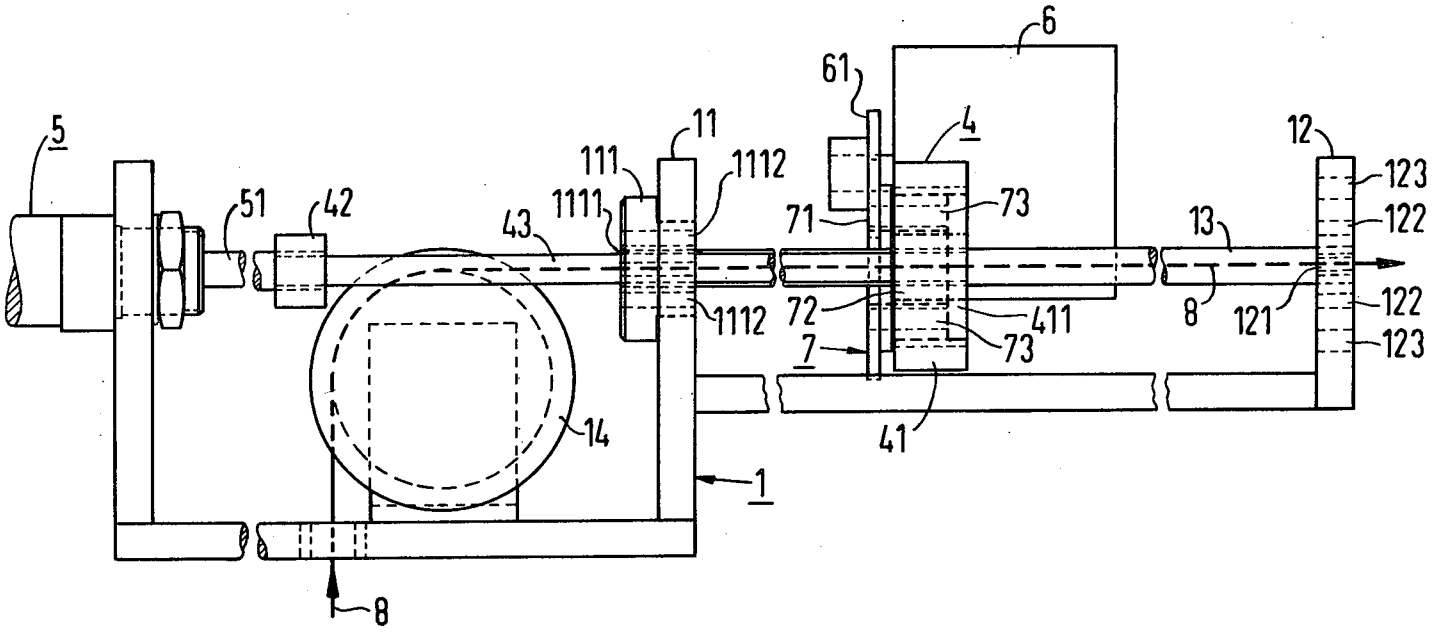

The invention is more closely explained on the basis of the Figures, wherein there is shown:

FIG. 1 illustrates a schematic representation of the winding device with the wire brake, FIG. 2 is a plan view of an inventive wire brake, and FIG. 3 is a side view of the wire brake pursuant to FIG. 2, however without the brake and pressure cable.

Pursuant to FIG. 1, the wire 8 is conducted from a supply container V over the wire brake B and an actual-value transmitter J for the wire tension to the winding station W of an automatic winding machine. A controller R varies the brake power output of the wire brake B in dependence upon the deviation of the actual value from a reference value which is predetermined by a reference value transmitter S. The reference value is determined experimentally for a predetermined winding shape, in which the braking power is constantly increased up to the value at which there is produced a satisfactory winding quality and the permissible wire expansion at a predetermined wire rotational speed. the therefor required brake power output is maintained by the controller even with the wear of the brake cable so that no excessively high braking values need be set.

The wire brake pursuant to FIGS. 2 and 3 consists of a support frame 1 with two end walls 11, 12 and guide rods arranged therebetween for the slidable carriage 4 which is supported thereon. The last-mentioned is coupled through the intermediary of pull rods 43, a drawbridge 42 and a tie rod 51, to a pneumatically-actuated stretching arrangement 5.

The carriage 4 includes a traverse 41 which is provided in its center with a bore 411 wherein there is rotatably supported the correcting or control element 7 for the pressure cable 3; it has in the center thereof a passage 72 for the brake cable 2 and the wire 8, and pickups 73 for the ends of the pressure strands 31 which are positioned therein. Preferably, four such pickups 73 are provided at a spacing of 90° for four pressure strands 31. The control element 7 is further equipped with a sprocket wheel 71 which is coupled through a chain 9 with the sprocket wheel 61 of a servo-motor 6 which is arranged on the carriage 4.

The end wall 12 evidences a passage 121 in the center thereof for the wire 8 and the encompassing pickups 122 and 123 for the other ends of the brake strands 21, respectively, the pressure strands 31, which presently lie in concentric circles at an equal distance from each other. The other ends of the brake strands 21 are positioned in the pickups 1112 of a twisting device 111, which is rotatably supported in the other end wall 11 and which includes a passage 1111 in the center thereof for the wire 8 which is conducted thereto over a guide roll 14.

With the aid of the twisting device the four strands 21 of the brake cable 2 are wound in a single layer without substantial tension about the wire 8; the therefor required position of the twisting device 111 is determined through suitable latching means.

The four strands 31 of the pressure cable 3 are wound in a single layer about the brake cable, whereby the braking force increases with reducing extent of motion of the individual brake strands (increasing angle between the brake strand and wire) and with the increasing pulling force of the stretching arrangement 5. The last-mentioned is preferably held at a constant value which, with consideration of the material and the length of the brake cable 2, as well as the shape of the winding and the winding rotational speed is determined experimentally. For the variation in the braking power output, the control elements 7 is rotated by the servo-motor 6, so that the pressure of the brake cable 2 against the wire 8 either is increased or reduced.

Deviating from the described embodiment, the control element 7 can also be arranged in the end wall 12; the servo-motor 6 must then be fastened on the support frame 1. This solution has not only mechanical advantages but is also satisfactory from a technological control aspect since the change in the braking force produced by the servo-motor is the strongest in the proximity of the control element, since then the winding station is located closer than in the previously described embodiment.

What is claimed is:

1. A wire brake for a wire winding machine for electrical cables, comprising;

a. a support frame;

b. a carriage slideably mounted on said support frame;

c. a stretching device coupled to said carriage for moving said carriage relative to said frame;

d. a plurality of brake strands, forming a brake cable, wound about the wire in a single layer and having first ends thereof fixedly clamped to said support frame;

e. a twisting device in said support frame and coupled to the second ends of said plurality of brake strands for selectively winding the second ends of said brake strands about the wire;

f. a plurality of pressure strands, forming a pressure cable, wound about said brake strands in a single layer and having first ends thereof coupled to said support frame; and g. a control element, rotatably supported by said carriage, coupled to the second ends of said pressure strands, for controlledly rotating the second ends of said pressure strands to control the pressure exerted on the brake strands on the wire to control braking thereof.

2. A wire brake as claimed in claim 1, wherein said brake strands comprise a soft material such that the surface of the wire located within the brake cable is at least up to 50% in contact with the brake strands.

3. A wire brake as claimed in claim 2, characterized in that said brake strands comprise strips of leather.

4. A wire brake as claimed in claim 1 or 2 or 3, wherein said control element is coupled to a servo motor controlled by a controller, and wherein the controller operates in dependence upon the deviation of an actual value obtained between the wire brake and a winding station for the tension of the wire relative to a reference value.

5. a wire brake as claimed in claim 4, characterized in that said stretching device exerts a constant force on the carriage.

* * * * *